United States Patent [19]

Silkebakken et al.

[11] 4,150,580

[45] Apr. 24, 1979

[54] GYROSCOPIC EXERCISER

[75] Inventors: Jerrold W. Silkebakken, Newport Beach; Bruce H. Hale, Irvine, both of Calif.

[73] Assignee: Newport Plastics, Inc., Costa Mesa, Calif.

[21] Appl. No.: 883,833

[22] Filed: Mar. 6, 1978

[51] Int. Cl.[2] ..... A63B 69/00; A63B 11/04

[52] U.S. Cl. ..... 74/5 R; 272/128; 272/127; 46/50

[58] Field of Search ..... 74/5 R; 272/128, 126, 272/127, 131, 132; 46/50, 60, 47, 75, 209, 62

[56] References Cited

U.S. PATENT DOCUMENTS

| | | | |
|---|---|---|---|
| 2,747,326 | 5/1956 | Doyle | 46/50 |
| 3,131,506 | 5/1964 | Fox | 272/128 X |
| 3,617,056 | 11/1971 | Herbold | 46/50 X |
| 3,737,162 | 6/1973 | Wood | 272/128 X |
| 3,756,592 | 9/1973 | Johnson | 272/128 |
| 3,841,627 | 10/1974 | Vetter | 272/128 |
| 3,843,117 | 10/1974 | Johnson | 272/128 |
| 3,901,503 | 8/1975 | Klose | 272/128 X |
| 4,077,626 | 3/1978 | Newman | 272/128 |

*Primary Examiner*—Samuel Scott

*Assistant Examiner*—Don E. Ferrell

*Attorney, Agent, or Firm*—George F. Bethel; Patience K. Bethel

[57] ABSTRACT

The following specification describes a rotor and case in a gyroscopic device generally forming a ball-shaped apparatus having an internal circular race. The internal circular race supports the rotor, which is mounted on a shaft that extends through the rotor and is received in an opening of a T-shaped cross sectioned ring which is placed within the race. The rotor rotates through the spin axis thereof, while at the same time a second axis at right angles that intercepts the spin axis is established around which the rotor will precess. By giving the rotor an initial spin and then holding the support structure or ball in the hand and manually applying a torque to the support structure or ball, the rotor will precess about the second axis of precession and produce a torque opposing the manually applied torque. The rotor is provided with fins for maintaining the rotor in a smooth moving configuration, while at the same time cooling the spinning rotor so as to eliminate frictional wear. In addition thereto, a mass is placed in circumferential relationship around the spin axis to increase the momentum of the rotor during its spinning movement.

12 Claims, 6 Drawing Figures

GYROSCOPIC EXERCISER

BACKGROUND OF THE INVENTION

1. Field of the Invention

The field of this invention lies within the gyroscopic art. More specifically, it lies within the field of providing a gyroscopic exerciser which when manually articulated provides for a torque that counters the manual articulation.

2. The Prior Art

The prior art related to this invention is primarily within the teachings of U.S. patent application Ser. No. 3,726,146 issued to Archie L. Mishler and the related references in the foregoing patent. In that patent, a gyroscopic exercising device is shown. The exercising device has a rotor which is fundamentally disk-shaped, and mounted within a ring in one embodiment, and within a ball form in another embodiment. The rotor in both cases is supported by a race or groove around the interior of the ring or ball. The race or the groove can be provided with a ball bearing or other means in order to provide smoother movement within the race.

A major drawback of the foregoing device was the fact that the race did not provide for bilaterally balanced support of the rotor. Furthermore, the race was incorporated within a structure in such a manner as to preclude a smooth running of the rotor in the race during precession. The foregoing caused substantial friction and an inability to maintain a smooth precession of the rotor which was the subject of the device and attendant exercise.

As a consequence, the inventor hereof established the fact that the ring of this device in which the rotor is journaled, as well as the ability of the ring to provide a smooth moving surface within the race is extremely beneficial. This allows for increased performance and the ability of the device to function in a truly utilitarian manner.

Another drawback of the prior art was that when the rotor spun in a circular or round container, it caused substantial friction therein. In particular, the speed at which the rotor turned was so high that when the rotor was implaced in the race, it tended to wear it out through high friction and attendant heat of the race.

In order to overcome the foregoing, the inventor has designed a rotor with a series of fins or blades which provide internal cooling of the entire device as the rotor turns. In addition to the foregoing fins of the entire device, the rotor is balanced with a metallic weight within the plastic rotor which is placed circumferentially around the spin axis. Thus, a high degree of mass concentration is maintained through the utilization of a metal ring within a plastic rotor.

As will be seen hereinafter, this invention overcomes the deficiencies of the prior art by providing a proper journaling and race for the rotor as it spins about its axis. In addition thereto, it provides increased mass to the rotor for improved performance. All the foregoing is substantially enhanced by virtue of the fins on the rotor providing a fanning and cooling of the gyroscopic exerciser as it rotates.

SUMMARY OF THE INVENTION

In summation, this invention provides a superior gyroscopic exerciser having an improved race, a superior means for journaling the gyroscopic rotor, fins for cooling the rotor, and an improved rotor with a high density rotor having a metallic ring displaced around the spin axis.

More particularly, the invention incorporates a substantially improved gyroscopic exerciser with a T ring that receives the axle ends of the rotor. The ends of the rotor are journaled within the T ring which is implaced within a race, so that it can precess around an axis outside the spin axis of the rotor. The T ring allows for smooth performance and an appropriate journaling of the rotor so that it will move with a limited amount of effort to maintain the precession. At the same time, it provides substantial reverse torque at high speeds to a user for exercise purposes.

The entire operation of the exerciser is improved by a metal insert ring within the plastic rotor to maximize the density for high speed rotational performance thereof. The metal ring is displaced around the spin axis to provide for high inertial movement during its spinning.

The rotor has fins which cause the intake of air through an opening and impel it within the housing. The intake of air circulates through the housing to cool the race and the extensions of the axle of the rotor so as to prevent undue heat and friction from building up and attendant deterioration of the exerciser.

All the foregoing provides for a well balanced gyroscopic exerciser with superior performance that will help to eliminate wear over an extended period of time.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 2:
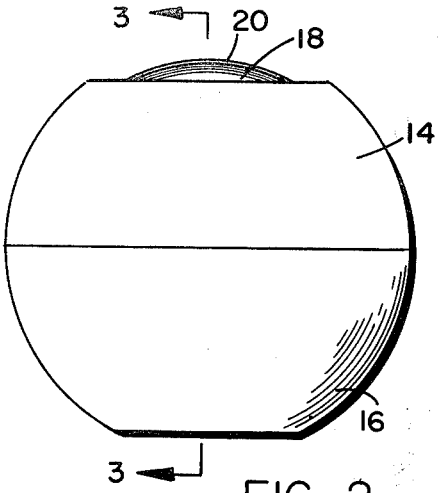
FIG. 2 shows a side elevation view of the gyroscopic exerciser.
Figure 1:
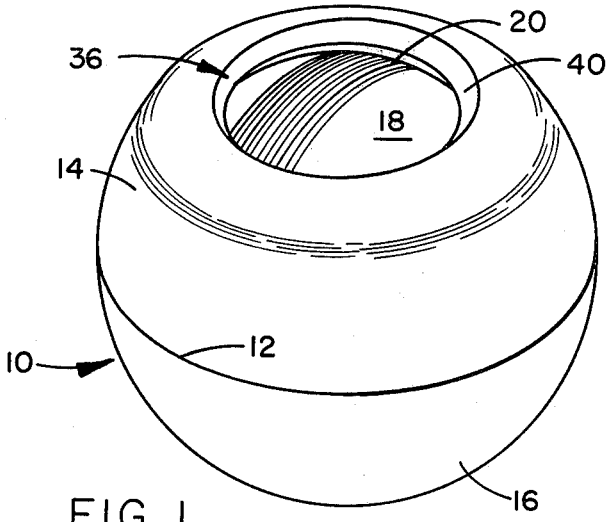
FIG. 1 shows a perspective view of the gyroscopic exerciser with the rotor exposed through an opening thereof.

Looking at FIG. 1 and the other figures that are ancillary thereto, it can be seen that a housing shell or body 10 is shown. The shell 10 is formed as a cup-shaped substantially spherical shell. The shell or body 10 is formed from a plastic in an injection molding process from two parts and has a line 12 where it is joined. The line 12 or parting line is such that it divides the shell or body 10 into two respective portions, namely, an open shell portion 14 and a closed shell portion 16. The open shell portion 14 and the closed shell portion 16 are respectively such that they allow for access to a rotor 18 having a plurality of relieved ribs 20 thereon.

The rotor 18 is formed from plastic and shall be described in detail hereinafter as to the different elements thereof.

The shell portions 14 and 16 mate along a circumferential splined portion such that the open shell 14 has an outer circular spline 24 and the lower shell 16 an inner circular spline 26. The outer spline 24 receives the inner spline 26 in mating engagement. This places the two in smooth circumferentially fit relationship to each other.

Interiorly of the inner spline 26 which circumferentially surrounds the entire closed portion of the shell member 16 is a groove 28 that is fundamentally a ledge in the wall of the lower shell. This ledge has an overlying portion 30 of the open shell portion 14 thereover, so that the two provide a groove or race in the entire circumference. The groove or race 32 comprising the ledge 28 and the overriding portion 30 journal an axle rod of the rotor 18 in a T ring which shall be described hereinafter.

The open shell portion 14 has an opening 36 with a clearance 38 therein to allow the rotor 18 to spin freely and provide for the movement of air through the opening 36. The major circumferential opening 36 is such that it is angled along a chamfer 40 so that there is a smooth edge region therearound.

The closed shell portion 16 has a flattened portion 48 so that the entire housing 10 can rest without rolling. In this manner, the entire shell can be laid down so that a non-rolling of the shell is prevented when it is placed on a flat surface.

The foregoing configuration of a shell or housing 10 can be of any suitable shape or size. In this particular instance, it has been shown with an enlarged cross sectional portion near the ledge 28 and the overriding surface 30. This is for reinforcement purposes around the groove, race or slot 32 so that it will enable the entire device to receive substantial stress when the rotor is spinning at high speed rotation.

Looking more particularly at the rotor 18, it can be seen that it comprises a plastic portion forming the major outer circumference 50. The major circumferential section 50 is of substantial thickness and is cast with a metallic ring 52 therein. The metallic ring 52 provides mass to the rotor 18 displaced around the spin axis so that it will spin with more inertia than if it were merely formed completely of plastic which is of a lighter density material.

The metal ring 52 is cast in place through an injection molding process and is held in situ by the frictional engagement within the plastic 50. Also, it can be held by a series of tabs or webs extending from the plastic 50 over the circumferential edge regions of the ring where it is exposed at points 54 and 56, as well as on the opposite bilaterally symmetrical side of the ring 50.

The rotor is supported by an axle 62 with ends 64 and 66 which extend outwardly so as to provide support within the groove or race 32. The ends of the axle 64 and 66 provide a rolling type of support within a T ring 68.

In the prior art, the axle ends 64 and 66 were supported in the groove or race 32 without any further support. This was found to be detrimental and as a consequence, this invention is in part directed toward the utilization of a T ring or interfacing member, such as the ring 68, or any other kind of ring which will allow smooth precession. Suffice it to say, any kind of support other than the T ring can also be utilized in order to provide the slippage necessary within the slot or race 32 while at the same time providing the support to the axle at points 64 and 66. In effect, the goal is to in some measure eliminate reverse non-rolling friction.

Figure 4:
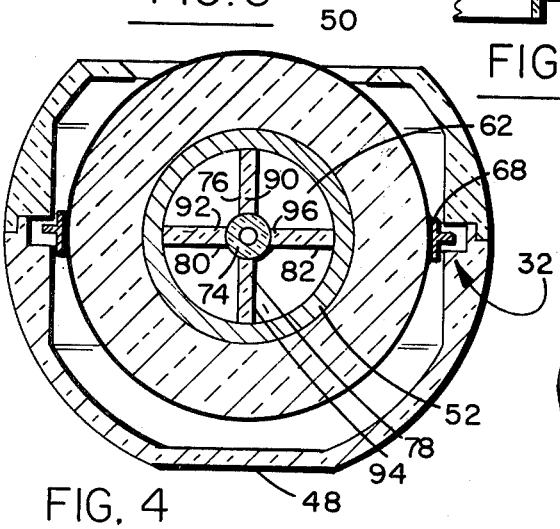
FIG. 4 shows a second sectional view looking at ninety degrees away from the sectional view shown in FIG. 3 along the direction of lines 4—4 of FIG. 3.
Figure 5:
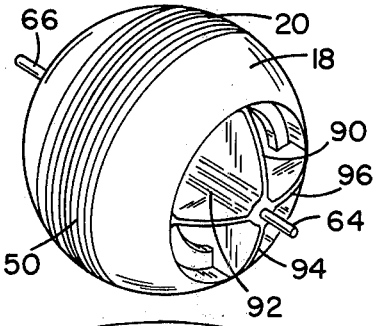
FIG. 5 shows an exploded view of the gyroscopic exerciser as exploded through a parting line of the exerciser shell; and, FIG. 6 shows a sectional view of the T ring as seen through lines 6—6 of the ring shown in the exploded view of FIG. 5.
Figure 5:
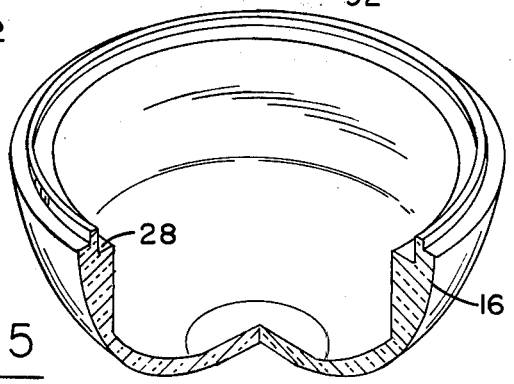

The axle 62 is supported within a tubular or cylindrical member 74 or axle mount having a plurality of extending webs 76, 78 and 80, the first two of which are shown in the end view of FIG. 4. The webs 76 and 78 and the other two webs 80 and 82 are fundamentally formed as a circumferential member surrounding the cylindrical or tubular axle support 74. They can be substituted by any suitable means for supporting the main plastic portion 50 and metal ring 52 by any sort of configuration and are not an absolute antecedent in form for the practice of the invention.

Figure 3:
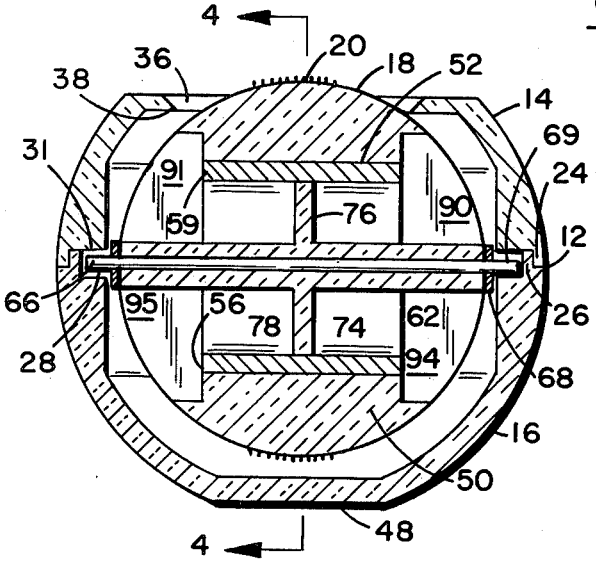
FIG. 3 shows a sectional view of the gyroscopic exerciser as seen through a midline sectional view along lines 3—3 of FIG. 2 exposing the metal axle passing therethrough.
Figure 6:
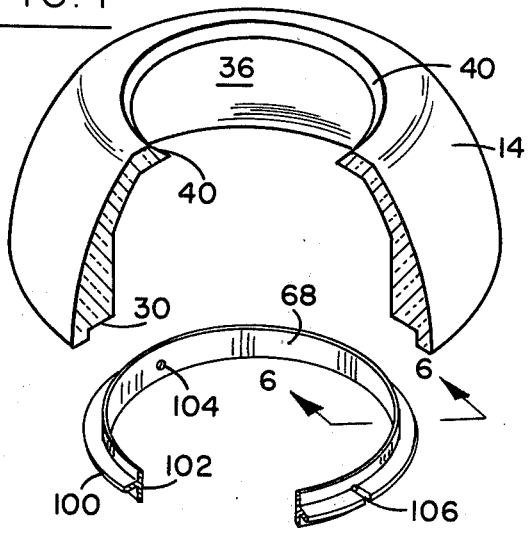
Figure 6:
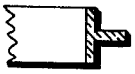

The entire rotor 18 is cooled by a plurality of fins 90, 92, 94 and 96. The fins 90 through 96 are bilaterally symmetrical with a second set of corresponding fins on the other side which correspond in like form on the opposite side from where they have been shown. Thus, fins 90 and 94 are analogous to opposite fins 91 and 95 that have been shown in FIG. 3. Suffice it to say, the fins are in bilaterally symmetrical orientation and are four in number to provide a pair of quadrants on either side of the rotor 18.

The fins maintain cooling through the opening 38 of the upper shell 14 by allowing the flow of air therethrough. This flow of air enables cooling to be maintained during the high rotational activity of the rotor 18. The fins act as an impeller and pull air into the shell 10 so that the exerciser is cooled over an extended period of time, thereby eliminating wear and long term deterioration to the gyroscopic exerciser.

The T ring 68 is comprised of a circumferential member having a T shaped cross section wherein the upright of the T is formed as member 100 and is inserted within the slot, groove or race 32. A transverse portion 102 rides around the periphery of the groove or race 32 and is maintained in spaced relationship through minor tolerances to the inner walls of the expanded portions of the upper and lower shells respectively 14 and 16.

The T ring 100 has two holes 104 and 106 passing through the upright and transverse portions respectively 100 and 102 of the T ring. These holes provide a journal in which the axle ends 64 and 66 can rotate. As the ends rotate within the openings 104 and 106 they are journaled therein, so that they do not rest directly on the surfaces of the slot, groove, or race 32.

The T ring 68 has a smooth finish and allows for a precession of the T ring 68 with the rotor 18 away from the spin axis, thereby providing a smooth well journaled support within the race or groove for the upright portion of the T ring.

Thus, the race 32 does not receive substantial reverse rolling friction of the axle ends 64 and 66 while at the same time the fins 90 through 96 provide a cooling of the entire device and the ring 52 increases the overall density for high speed rotation.

The rotor 18 can be started by engagement against any surface, such as a hand or flat member, with a slight movement to start it rolling. After the rotor is rolling about its spin axis, it tends to increase its rate of rotation by a torque applied manually by movement of one's hand to oppose the torque caused by the rotor. The required manually applied opposing torque causes an exercising effect to a substantial degree. The rotor 18 can be spun at substantially high revolutions by such activity for an extended period of time, while at the same time maintaining cooling and smooth operation of the rotor by the fins and T ring.

From the foregoing, it can be seen that this invention is a substantial improvement and practical extension of the prior art. Thus, the scope and spirit of the invention is only to be read in relationship to the following claims.

We claim:

1. A gyroscopic exercising device in which a rotor is journaled for rotation about its spin axis in a casing designed for gripping, so that a countervailing moment to the moment of precession can be manually implemented to provide exercise by one exerting the countervailing moment wherein the improvement comprises:
- a generally rounded shell having at least one opening therein;
- a rotor within said shell mounted for extension through the opening of said shell;
- a groove on the interior of said shell providing a race;
- an axle supporting said rotor; and,
- axle support means within said race at least partially circumferentially oriented in said race interfacing said axle and the surface of said race.

2. The gyroscopic exerciser as claimed in claim 1 wherein said axle support means comprises:
- a ring having a portion extending into said race circumferentially surrounding the interior of said shell with a portion extending from said ring outside of said race.

3. The gyroscopic exerciser as claimed in claim 2 wherein:
- said axle support means has a substantially T shaped cross section; and,
- said axle of said rotor extends thereinto.

4. The gyroscopic exerciser as claimed in claim 3 further comprising:
- a plastic rotor; and,
- a metallic member within said plastic rotor displaced at least in part around the spin axis for providing increased density and attendant inertia thereto.

5. The gyroscopic exerciser as claimed in claim 1 further comprising:
- a composite plastic rotor having a metallic ring member that has been formed therein.

6. The gyroscopic exerciser as claimed in claim 1 further comprising:
- fins oriented on said rotor for providing circulatory air to said rotor.

7. The gyroscopic exerciser as claimed in claim 3 wherein:
- the upright portion of the T forming said axle supporting means is inserted into the race; and,
- said axle extends into the upright portion of the T shaped member.

8. A gyroscopic exerciser comprising:
- a rounded shell member;
- a rotor having an axle extending through the rotor;
- a race formed within said shell member;
- means in circumferential relationship within said race for receiving the ends of said axle; and,
- a plurality of fins on said rotor for providing circulatory air within said shell as said rotor is rotated.

9. The gyroscopic exerciser as claimed in claim 8 wherein:
- said axle receiving means has a T shaped cross section.

10. The gyroscopic exerciser as claimed in claim 9 wherein:
- said rotor is formed of plastic; and,
- a metallic member is formed in said rotor for providing increased density thereto.

11. The gyroscopic exerciser as claimed in claim 10 wherein:
- said metallic member comprises a ring shaped member circumscribing said axle.

12. The gyroscopic exerciser as claimed in claim 11 wherein:
- said fins extend radially from the center of said rotor and said shell has an opening therein for receiving air when said fins move in order to create circulation within said shell; and wherein,
- said rotor extends through the opening of said shell to allow starting rotation thereof.

* * * * *